US009324528B1

(12) United States Patent
Mittu et al.

(10) Patent No.: US 9,324,528 B1
(45) Date of Patent: Apr. 26, 2016

(54) MAGNETIC TRIP MECHANISM FOR CIRCUIT BREAKER

(71) Applicant: General Electric Company, Schenectady, NY (US)

(72) Inventors: Mahadeva Mittu, Karnataka (IN); Gajendra Vijaykumar Kadam, Telangana (IN); Mahesh Jaywant Rane, Telangana (IN); Hemraj Keda Thorat, Telangana (IN); Anurag Arjundas Jivanani, Unionville, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/543,268

(22) Filed: Nov. 17, 2014

(51) Int. Cl.
*H01H 71/24* (2006.01)
*H01H 71/52* (2006.01)

(52) U.S. Cl.
CPC ..... *H01H 71/2472* (2013.01); *H01H 71/52* (2013.01); *H01H 2205/002* (2013.01)

(58) Field of Classification Search
CPC ..... H01H 71/2472; H01H 71/52; H01H 2205/002
See application file for complete search history.

(56) References Cited

U.S. PATENT DOCUMENTS 4,215,328 A 7/1980 Chabot et al.
4,301,435 A 11/1981 Castonguay et al.
5,341,191 A 8/1994 Crookston et al.
6,175,288 B1 * 1/2001 Castonguay ..... H01H 71/2472 218/22
6,218,920 B1 * 4/2001 Reichard ..... H01H 71/7463 335/172
6,225,881 B1 * 5/2001 Felden ..... H01H 71/04 335/167
6,281,458 B1 8/2001 Castonguay et al.
6,744,339 B2 6/2004 Daehler et al.
6,794,963 B2 9/2004 O'Keeffe et al.
6,853,277 B2 2/2005 Castonguay et al.
7,515,025 B2 4/2009 Mrowiec et al.
2013/0306454 A1 11/2013 Nickerson et al.

OTHER PUBLICATIONS

Eaton Corporation, "Molded-Case Circuit Breakers & Enclosures," Dec. 2013; pp. 27.0-1-27.4-56.

* cited by examiner

*Primary Examiner* — Mohamad Musleh
(74) *Attorney, Agent, or Firm* — GE Global Patent Operation; Stephen G. Midgley

(57) ABSTRACT

A magnetic trip mechanism for a circuit breaker includes an electrically conductive strap having a first wall portion and a second wall portion that define an interior space therebetween. Also included is a flux block disposed at least partially within the interior space, and movable in response to a short circuit condition of the circuit breaker. Further included is a trip lever operatively coupled to the flux block. Yet further included is a trip latch moveable between a latched condition and an unlatched condition with a handle, wherein rotation of the trip lever occurs in response to the short circuit condition and causes movement from the flux block to actuate the trip latch to the unlatched condition.

18 Claims, 4 Drawing Sheets

MAGNETIC TRIP MECHANISM FOR CIRCUIT BREAKER

BACKGROUND OF THE INVENTION

The subject matter disclosed herein relates to circuit breakers and, more particularly to a magnetic trip latch mechanism for circuit breakers for tripping the circuit breaker in the event of a short circuit condition.

Circuit breakers are used to protect equipment from overcurrent situations caused, for example, by short circuits or ground faults in or near such equipment. In the event an overcurrent condition occurs, electrical contacts within the circuit breaker will open, stopping the flow of electrical current through the circuit breaker to the equipment. Circuit breakers may be designed for high quiescent currents and high withstand currents. To maintain a high withstand current rating, the contacts must be clamped closed at the current withstand rating. On the other hand, at the short circuit current level, the contacts must be capable of opening quickly. The drawback of having the contacts clamped close is that the contacts may not be able to open quickly at the short circuit current level.

BRIEF DESCRIPTION OF THE INVENTION

According to one aspect of the invention, a magnetic trip mechanism for a circuit breaker includes an electrically conductive strap having a first wall portion and a second wall portion that define an interior space there between. Also included is a flux block disposed at least partially within the interior space, and rotatable in response to a short circuit condition of the circuit breaker. Further included is a trip lever operatively coupled to the flux block. Yet further included is a trip latch moveable between a latched condition and an unlatched condition with a handle, wherein movement of the trip lever occurs in response to the short circuit condition and causes movement from the flux block to actuate the trip latch to the unlatched condition.

According to another aspect of the invention, a circuit breaker includes a rotatable contact arm having a moveable contact operatively coupled thereto. Also included is an electrically conductive strap and a fixed contact operatively coupled to the electrically conductive strap. Further included is a flux block at least partially surrounded by the electrically conductive strap, wherein rotation of the flux block is actuated during a short circuit condition of the circuit breaker. Yet further included is a trip lever operatively coupled to the flux block. Also included is a trip latch moveable between a latched condition and an unlatched condition with a handle, wherein movement of the trip lever occurs in response to the short circuit condition and causes movement from the flux block to actuate the trip latch to the unlatched condition.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
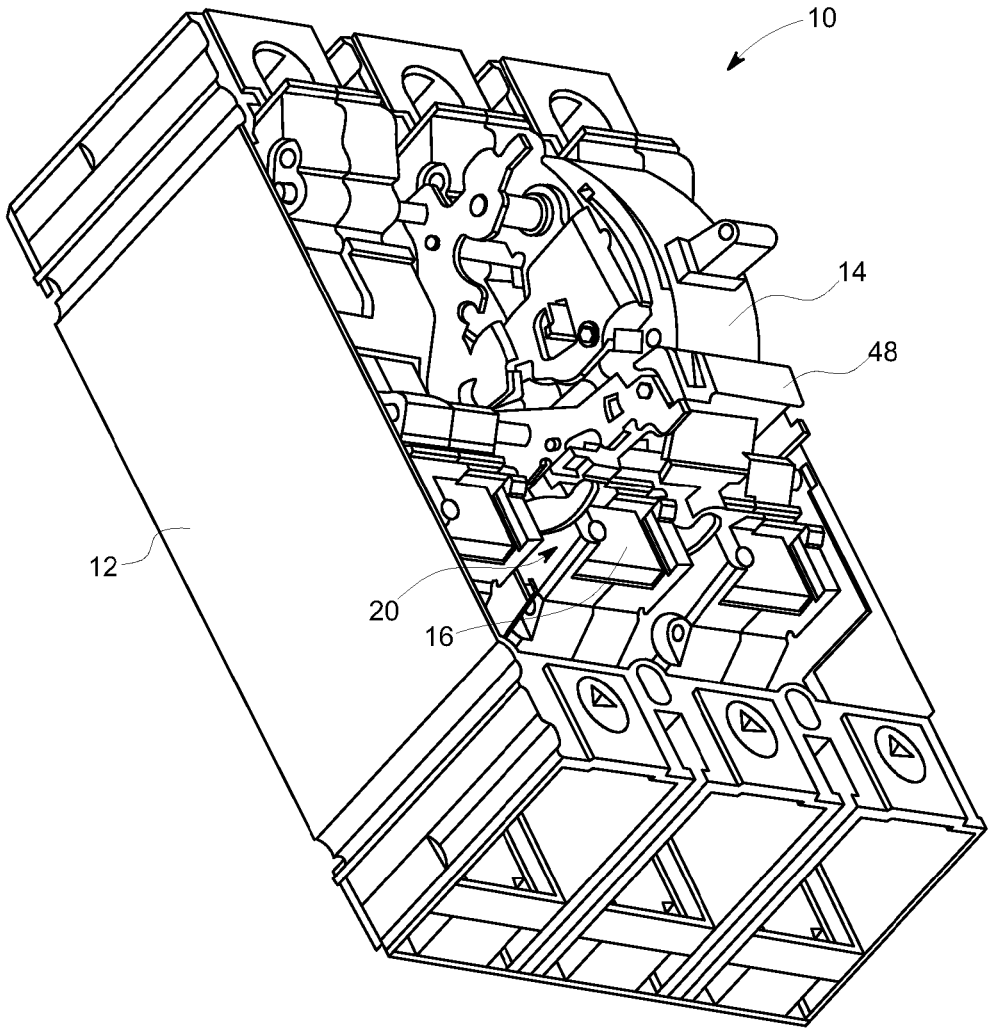
FIG. 1 is a perspective view of a multi-pole circuit breaker.
Figure 2:
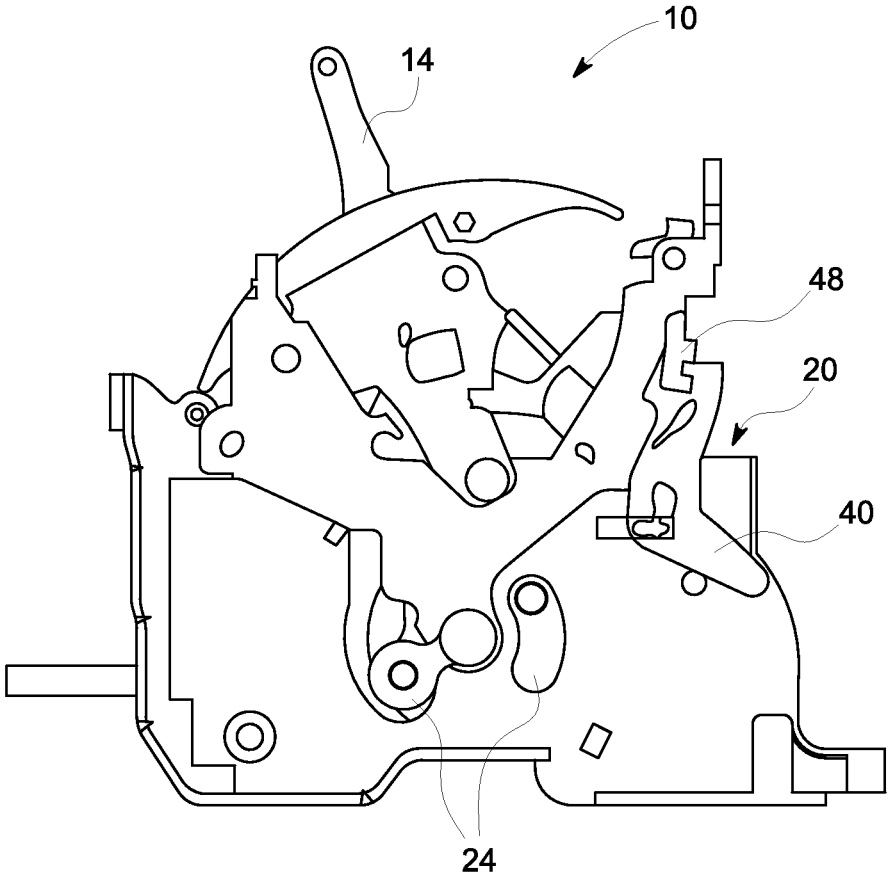
FIG. 2 is a side, elevation schematic view of a portion of the circuit breaker.
Figure 3:
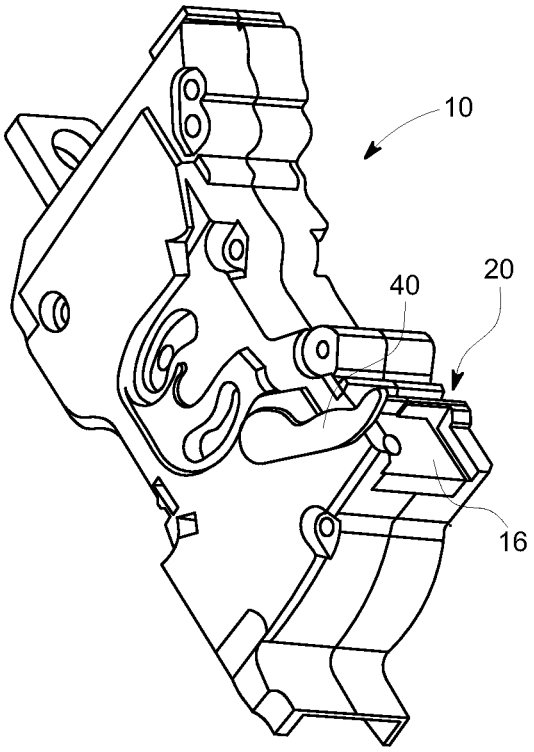
FIG. 3 is a perspective view of a pole assembly of the circuit breaker having a magnetic trip latch mechanism.
Figure 4:
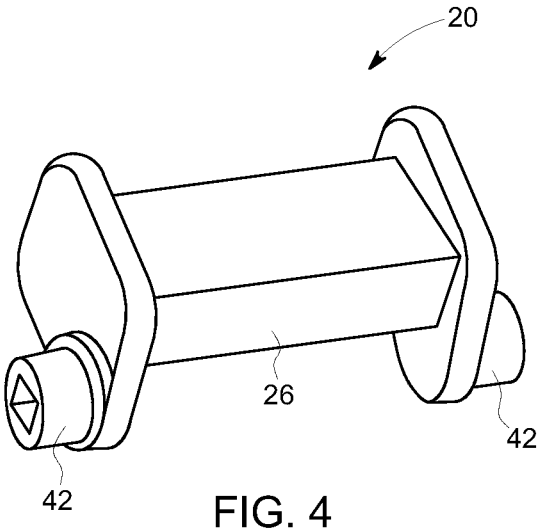
FIG. 4 is a perspective view of a portion of the magnetic trip latch mechanism.

Referring to FIGS. 1 and 2, a circuit breaker 10 of the multi-pole variety is partially illustrated. The circuit breaker 10 has a cover removed to better illustrate various components located within a housing 12 of the circuit breaker 10. A handle 14 is configured to extend through the cover to give an operator the ability to turn the circuit breaker 10 "ON" to energize a protected circuit, turn the circuit breaker "OFF" to disconnect the protected circuit breaker, or reset the circuit breaker after a fault. At least one line strap or contact and at least one load strap 16 is configured to connect the circuit breaker 10 to line and load conductors of the protected circuit, with the line strap and the load strap 16 being formed of an electrically conductive material. The circuit breaker 10 illustrated depicts a three-phase configuration, however, the embodiments disclosed herein are not limited to this configuration, such that alternative phase configurations (e.g., one-phase, two-phase, four-phase, etc.) may be employed.

The circuit breaker 10 includes a magnetic trip mechanism 20 configured for sensing a predetermined high withstand current in the circuit breaker 10 and maintaining contact between contact structures (not illustrated) during the predetermined high withstand current. The magnetic trip mechanism 20 is also configured for sensing a predetermined short circuit current and quickly tripping an operating mechanism that the handle 14 is configured to operate in order to separate the contact structures in response to the short circuit current. In particular, the handle 14 is configured to manipulate a rotatable contact arm 24 having a moveable contact operatively coupled to an end of the rotatable contact arm 24. The load strap 16 includes a fixed contact operatively coupled thereto. The fixed contact is configured to be in contact with the moveable contact of the rotatable contact arm 24 to allow electrical current to flow from the line strap to the load strap 16.

Figure 5:
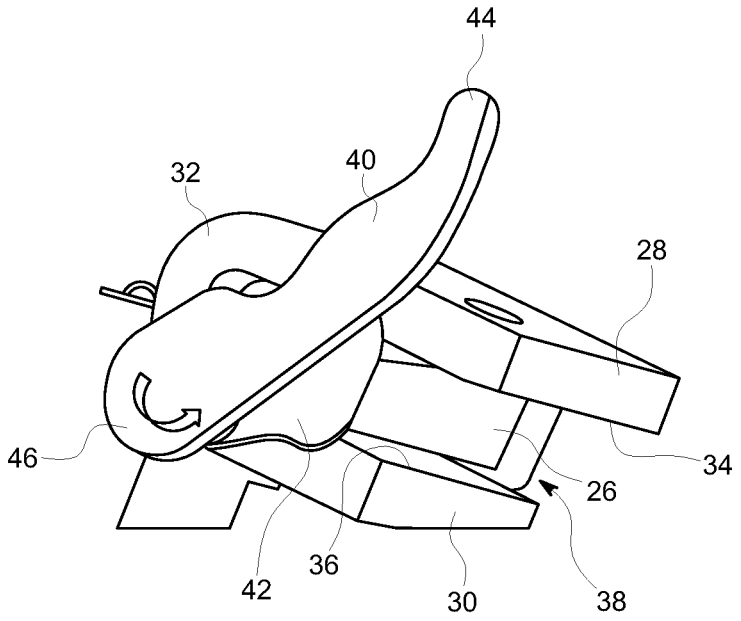
FIG. 5 is a perspective view of the magnetic trip latch mechanism having a flux block configured to rotate.
Figure 6:
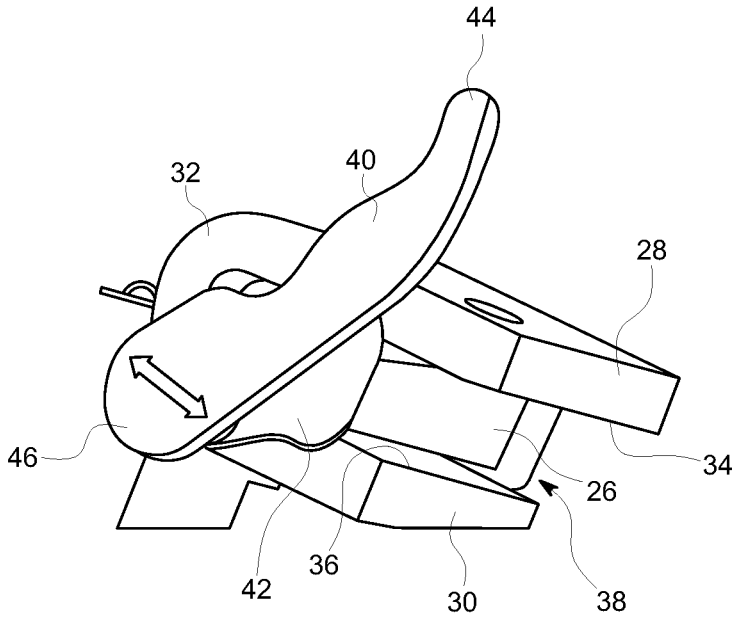
FIG. 6 is a perspective view of the magnetic trip latch mechanism having a flux block configured to translate.

Referring now to FIGS. 3-6, the magnetic trip mechanism 20 is illustrated in greater detail. The magnetic trip latch mechanism includes a flux block 26 (also referred to as a shunt block, magnetic flux block, or flux shunt block) at least partially encased by the load strap 16. The load strap 16 includes a first wall portion 28 and a second wall portion 30 that are joined by an end wall portion 32 (FIGS. 5 and 6). The first wall portion 28 and the second wall portion 30 are spaced from each other such that a first wall portion inner surface 34 and a second wall portion inner surface 36 define an interior space 38 therebetween. The flux block 26 is at least partially disposed within the interior space 38 of the load strap 16. The flux block 26 may be further encased by components of the pole assembly that are aligned substantially perpendicular to the first wall portion 28 and the second wall portion 30.

The flux block 26 is formed of a material (e.g., steel) that concentrates magnetic flux during a short circuit condition.

The concentration of the magnetic flux imparts movement of the flux block 26 during a short circuit condition. In one embodiment, the interior space 38 of the load strap 16 is configured to allow rotation of the flux block 26 (FIG. 5). The range of angular displacement of the flux block 26 will vary depending on the particular application of use. In some embodiments, the angular range of motion is less than about five degrees. In another embodiment, the interior space 38 of the load strap 16 is configured to allow translation of the flux block 26 (FIG. 6). The range of translation of the flux block 26 will vary depending on the particular application of use. In some embodiments, the translational range of motion is less than about two millimeters. In yet other embodiments, the flux block 26 is configured to rotate and translate within the interior space 38.

As the flux block 26 is moved, whether translationally, rotationally or both, the flux block 26 imparts movement of a trip lever 40 to which the flux block 26 is operatively coupled to. The operative coupling of the trip lever 40 and the flux block 26 may be a directly coupled arrangement or may include one or more intermediate coupling elements, such as the coupling element 42 illustrated in FIGS. 4-6. Although a single trip lever is described herein for purposes of simplicity, it is to be understood that an additional trip lever is operatively coupled to the flux block 26 at an opposite side of the flux block 26. The trip lever 40 extends from a first end 44 to a second end 46. The operative coupling of the trip lever 40 to the flux block 26 is made proximate the second end 46 in the illustrated embodiment, however, other locations are contemplated, such as closer to a midpoint of the trip lever 40.

As the trip lever 40 is rotated and/or translated, the first end 44 interacts with a trip latch 48 (FIGS. 1 and 2). The trip latch 48 is configured to engage the handle 14 in a latched condition that corresponds to a contacted condition of the fixed and moveable contacts discussed above. The trip lever 40 may be in constant contact with the trip latch 48 or may be spaced therefrom prior to movement initiated by the flux block 26. In the event of a short circuit condition, the trip lever 40 is biased against the trip latch 48 in a manner that forces the trip latch 48 to move to an unlatched condition relative to the handle 14, thereby opening the contacts to interrupt the circuit (i.e., tripping the circuit).

At this point, it should be appreciated that the magnetic trip of the circuit breaker 10 is solely facilitated by the magnetic trip mechanism 20. Advantageously, an instantaneous override is provided to achieve current limiting at lower fault levels. By clearing the fault quickly with simply magnetic flux-initiated movement, less damage to contacts is observed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A magnetic trip mechanism for a circuit breaker comprising:

an electrically conductive strap having a first wall portion and a second wall portion that define an interior space therebetween;

a flux block disposed at least partially within the interior space, and rotatable in response to a short circuit condition of the circuit breaker;

a trip lever operatively coupled to the flux block; and a trip latch moveable between a latched condition and an unlatched condition with a handle, wherein movement of the trip lever occurs in response to the short circuit condition and causes movement from the flux block to actuate the trip latch to the unlatched condition.

2. The magnetic trip mechanism of claim 1, the flux block angularly rotatable over a range of angular movement of five degrees or less.

3. The magnetic trip mechanism of claim 1, wherein the flux block is translatable.

4. The magnetic trip mechanism of claim 3, the flux block translatable over a range of two millimeters or less.

5. The magnetic trip mechanism of claim 1, further comprising a coupling element operatively coupled to the flux block and to the trip lever.

6. The magnetic trip mechanism of claim 1, the trip lever having a first end and a second end, the first end disposed proximate the trip latch.

7. The magnetic trip mechanism of claim 6, the first end in constant contact with the trip latch and further comprising a spring for biasing the trip lever to the latched condition.

8. The magnetic trip mechanism of claim 6, the trip lever operatively coupled to the flux block proximate the second end of the trip lever.

9. The magnetic trip mechanism of claim 1, wherein the flux block is formed of steel.

10. A circuit breaker comprising:

a rotatable contact arm having a moveable contact operatively coupled thereto;

an electrically conductive strap;

a fixed contact operatively coupled to the electrically conductive strap;

a flux block at least partially surrounded by the electrically conductive strap, wherein rotation of the flux block is actuated during a short circuit condition of the circuit breaker;

a trip lever operatively coupled to the flux block; and a trip latch moveable between a latched condition and an unlatched condition with a handle, wherein movement of the trip lever occurs in response to the short circuit condition and causes movement from the flux block to actuate the trip latch to the unlatched condition.

11. The circuit breaker of claim 10, the flux block angularly rotatable over a range of angular movement of five degrees or less.

12. The circuit breaker of claim 10, wherein the flux block is translatable.

13. The circuit breaker of claim 12, the flux block translatable over a range of two millimeters or less.

14. The circuit breaker of claim 10, further comprising a coupling element operatively coupled to the flux block and to the trip lever.

15. The circuit breaker of claim 10, the trip lever having a first end and a second end, the first end disposed proximate the trip latch.

16. The circuit breaker of claim 15, the first end in constant contact with the trip latch and further comprising a spring for biasing the trip lever to the latched condition.

17. The circuit breaker of claim 15, the trip lever operatively coupled to the flux block proximate the second end of the trip lever.

18. The circuit breaker of claim 10, wherein the flux block is formed of steel.

* * * * *